US005839424A

United States Patent [19]

Hauser

[11] Patent Number: 5,839,424

[45] Date of Patent: Nov. 24, 1998

[54] PROCESS FOR THE ORIENTATION OF SEVERAL SINGLE CRYSTALS DISPOSED SIDE BY SIDE ON A CUTTING SUPPORT FOR THEIR SIMULTANEOUS CUTTING IN A CUTTING MACHINE AND DEVICE FOR PRACTICING THIS PROCESS

[75] Inventor: Charles Hauser, Genolier, Switzerland

[73] Assignee: HCT Shaping System SA, Cheseaux, Switzerland

[21] Appl. No.: 834,418

[22] Filed: Apr. 16, 1997

[30] Foreign Application Priority Data

Apr. 16, 1996 [CH] Switzerland ..... 957/96

[51] Int. Cl.[6] ..... B24D 3/00

[52] U.S. Cl. ..... 125/16.02; 125/35; 125/16.01; 125/28; 451/73; 451/460

[58] Field of Search ..... 451/73, 460; 125/16.02, 125/35, 16.01; 378/73

[56] References Cited

U.S. PATENT DOCUMENTS

| | | | |
|---|---|---|---|
| 2,947,215 | 8/1960 | Schwuttke et al. | 125/35 |
| 4,710,259 | 12/1987 | Howe et al. | 378/73 |
| 5,201,305 | 4/1993 | Takeuchi | 125/21 |
| 5,720,275 | 2/1998 | Hauser | 125/16.02 |

FOREIGN PATENT DOCUMENTS

| | | | |
|---|---|---|---|
| 275925 | 5/1979 | Germany | 125/35 |
| 112755 | 8/1980 | Japan | 125/21 |

*Primary Examiner*—Robert A. Rose
*Assistant Examiner*—George Nguyen
*Attorney, Agent, or Firm*—Young & Thompson

[57] ABSTRACT

The process and device (1) for positioning several single crystals (2) on a support (3) for their simultaneous cutting in directions well defined relative to the crystal structure of each single crystal; they avoid the adjustment in the machine and minimize the cutting time by providing a positioning outside the machine about angles of rotation (d,g) obtained mathematically from measured and/or given data and which position each geometric single crystal in a plane perpendicular to the cutting direction (z'''') whilst bringing the cutting plane of each single crystal (2) parallel to the cutting direction of the machine. The device for practicing the process comprises a frame (5), a gripping device (8) mounted rotatably on the frame and carrying single crystals (2) and a rotatable plate (11) adapted to maintain the cutting support (3) belonging both to the positioning device (1) and to the cutting machine. By a raising mechanism (9), the support (3) and each single crystal (2) are placed into contact and secured together after having obtained their predetermined relative orientation by rotation about the axes x and z'''. The process and the device permit obtaining exact positioning of each single crystal (2) outside the machine under desirable conditions, a compact mounting, optimized for several single crystals on the cutting support and a precise cutting with maximum productivity.

13 Claims, 6 Drawing Sheets

PROCESS FOR THE ORIENTATION OF SEVERAL SINGLE CRYSTALS DISPOSED SIDE BY SIDE ON A CUTTING SUPPORT FOR THEIR SIMULTANEOUS CUTTING IN A CUTTING MACHINE AND DEVICE FOR PRACTICING THIS PROCESS

BACKGROUND OF THE INVENTION

The present invention relates to a process for the orientation of single crystals for their cutting in a cutting machine along a predetermined cutting plane.

Single crystals, generally for optical or semiconductor use, require that they be cut according to very precise orientations relative to the axes of the crystal lattice. Moreover, their production does not permit perfectly controlling the orientation of the crystal axes relative to the geometric axes. It is therefore necessary, in order that the cutting be correct, to correct the production error and to take account of the angles formed between the cutting plane and the crystal plane selected or imposed by the subsequent uses or processes. Given that cutting takes place on geometric single crystals, it will be necessary to position and maintain them in space such that the displacement of the cutting system will be parallel to the desired cut of each of the single crystals. There exist an infinite number of possible positions; however there are only four per single crystal which moreover dispose it in a plane perpendicular to the cutting plane of the machine. The positioning of each of the single crystals according to one of these four positions therefore permits cutting not only in the desired orientation but also to minimize the cutting time and to supply in an optimum manner the cutting machine, hence to improve the productivity of the cutting device.

DESCRIPTION OF THE RELATED ART

Devices for orienting single crystals are already known and used in the semiconductor industry for internal diameter slicers or in wire saws. Positioning takes place with a table orientable according to y''',z''' mounted directly on the machine. Adjustment takes place after optical or x-ray measurement. The y''',z''' correction is then introduced. This technique has the disadvantage on the one hand of having a position of the single crystal inclined relative to the advance of the cutting element, which is very unfavorable in the case of a wire saw in which the layer of wires must be parallel to the geometry of the single crystal, and on the other of minimizing the cutting length, which is unfavorable for internal diameter saws by decreasing their productivity. Moreover, this technique requires adjusting the machine table before each cut, in a very precise way, and in an industrial environment which is often dirty and hence little suited to this type of operation. The adjustment time for the machine also contributes to a reduction of productivity. This technique also does not permit simultaneous cutting of plural single crystals having different orientations from each other.

The cutting machine has a fixed table length, whilst the single crystals themselves can have variable lengths because of quality or production considerations. The cutting time in the case of a wire saw is independent of the length to be cut. It is hence necessary to have maximum supply if it is desired to have maximum productivity. This maximum supply can take place only by combining several single crystals oriented according to a technique using for each of them the axes which define a plane perpendicular to the cutting plane and which also define the single crystal geometry.

SUMMARY OF THE INVENTION

The present invention has for its object to overcome the mentioned drawbacks and to permit precise adjustment of the positioning of each single crystal mounted on a common cutting support in a clean environment and to increase the cutting productivity.

The invention is characterized to this end by the characteristics recited in the independent claims, namely by the fact that several single crystals are prepared for simultaneous cutting, each of the single crystals is successively oriented by means of a positioning device outside the cutting machine according to a predetermined orientation relative to a cutting support, each of the single crystals having said predetermined orientation is fixed successively on the cutting support whose emplacement in the cutting machine is geometrically defined relative to the cutting plane of the machine, and the cutting support is arranged, after securement of the single crystals in the cutting machine, according to said defined geometric emplacement, to obtain said predetermined orientation of each single crystal in the cutting machine and simultaneously all the single crystals mounted on the cutting support are cut.

With these characteristics, it is possible to obtain precise positioning and orientation of each of the single crystals constituting the cutting supply in a favorable measurement environment, without it being necessary to carry out any positional adjustment in the cutting machine. The down time of this latter can therefore be considerably decreased and the quantity of slices produced per cutting load being maximum, the productivity of the cutting machine is correspondingly increased.

In a preferred embodiment, the invention is characterized by the fact that said predetermined orientation is obtained by arranging each single crystal on the positioning device such that one of its geometric axes of the geometric shape of each single crystal will lie in a reference plane corresponding to the working plane of the cutting machine perpendicular to the cutting plane, by carrying out a rotation of each single crystal from a first predetermined angle suitable to each single crystal about said geometric axis to bring the normal to the cutting plane of the single crystal into the reference plane, and by carrying out a relative rotation between the cutting support and each single crystal from a predetermined second angle for each single crystal about an axis perpendicular to said reference plane such that the normal to the cutting plane will be oriented in a reference direction corresponding to the normal to the cutting plane of the machine, said geometric axis and the normal to the cutting plane of each single crystal lying in said reference plane.

There is thus remedied in a precise and easy manner the disadvantage of having a position of the single crystals inclined relative to the direction of advance of the cutting elements of the machine, which is particularly unfavorable for wire saws. The principal geometric axis of each of the single crystals can thus be oriented perfectly parallel to the working plane and to the layer of wires, thereby obtaining optimum cutting whilst minimizing the cutting length and maximizing the supply of material to be cut.

Preferably, the process used by the present invention is characterized in that the orientation of the cutting plane is defined for each single crystal relative to the crystal lattice, in that the orientation of the crystal lattice relative to the geometric shape of each single crystal is measured, and in that the first and second angles of rotation are calculated having regard to the orientation of the cutting plane relative to the crystal lattice and relative to the geometric shape of each single crystal.

With these characteristics, there is obtained a high precision of positioning and very rapid mounting.

The process according to the invention is applicable particularly preferably to the use of single crystals whose geometric shape is substantially cylindrical, said geometric axis corresponding to the principal axis of the single crystal.

The invention is also applicable to a device for practicing the process, which is characterized by the fact that it comprises a positioning device adapted to orient the single crystals corresponding to the supply to be cut, outside the cutting machine, according to a predetermined orientation for each single crystal relative to a cutting support on which the single crystals are adapted to be secured and whose emplacement in the cutting machine is geometrically defined and whose principal axes are parallel to the axes of the cutting machine.

This device for practicing the process is preferably characterized by the fact that it comprises first means to support the single crystals in an orientation such that one of the geometric axes of the geometric shape of each single crystal in the course of being mounted lies in a reference plane corresponding to the working plane of the cutting machine and effecting a rotation of said single crystal from a first predetermined angle about said geometric axis so as to bring the normal to the cutting plane of the single crystal being mounted, into said reference plane, and second means to carry out a relative rotation between the cutting support and each single crystal being mounted, from a second predetermined angle, about an axis perpendicular to said reference plane, such that the normal to the cutting plane will be oriented in a reference direction corresponding to the normal to the cutting plane of the machine, and by the fact that it comprises third means to carry out a relative translatory movement between the single crystal and the cutting support adapted to position in the most compact manner the single crystal being mounted with the single crystals already mounted on the cutting support, and fourth means to carry out a relative perpendicular translatory movement to bring together the cutting support and the single crystal so as to secure the latter on the cutting support in said predetermined orientation, and that the operation can be repeated several times by assembling in a compact manner on the cutting support the single crystals constituting the supply to be cut.

With these characteristics, there is obtained a rapid and precise positioning adapted to cutting machines, permitting exact cutting of each single crystal in a minimum time, independent of the number of single crystals constituting the supply to be cut. Moreover, the cutting position will be independent of the cutting machine used or of the operator in the case of mass production.

A suitable technique is characterized by the fact that the first means comprise a gripping system mounted rotatably relative to an axis of rotation on an upper portion of the frame of the positioning device and arranged so as to support the single crystal, and a first angular measuring member adapted to determine the first predetermined angle of rotation, by the fact that the second means comprise a rotatable plate mounted pivotally relative to said frame and whose principal plane is parallel to said reference plane and to the axis of rotation of the gripping system, this rotatable plate being arranged so as to maintain the cutting support in a predetermined geometrical position, a second angular measuring member being provided to determine said second predetermined angle of rotation, by the fact that the third means comprise a translatory mechanism parallel to said axis of rotation, permitting positioning the single crystal in the most compact manner with the other single crystals mounted before or after it on the cutting support, by the fact that the fourth means comprise a translatory mechanism in a direction perpendicular to said reference plane permitting bringing together the cutting support and the single crystal, and by the fact that the cutting support is so shaped that its positioning in the cutting machine takes place according to a geometric position corresponding to the geometric position defined in said rotatable plate such that the reference plane and the reference direction correspond to the working plane and to the normal to the cutting plane of the machine.

These characteristics permit a positioning of several single crystals on the same cutting support, which will be particularly simple, rapid and trouble free, whilst ensuring high cutting precision of all the single crystals.

Other advantages will appear from the characteristics set forth in the dependent claims and from the following description setting forth the invention in greater detail with the aid of the drawings which show schematically and by way of example one embodiment.

DESCRIPTION OF THE PREFERRED EMBODIMENTS

Figure 1:
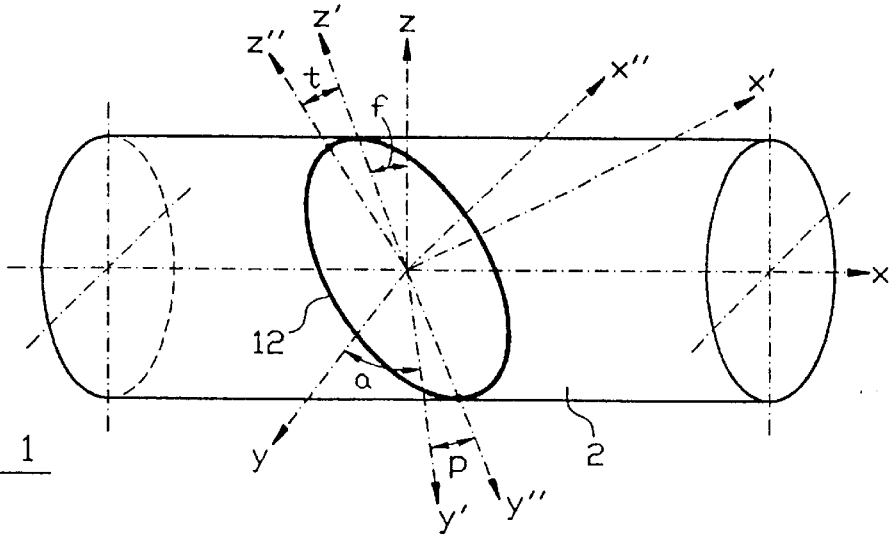
FIG. 1 shows in perspective an example of a single crystal with its geometric and crystallographic planes and the selected cutting plane.

Generally speaking, the invention provides the possibility of installing on the cutting machine preoriented single crystals mounted on the same cutting support and whose cutting plane is oriented parallel to the cutting plane of the machine, so as to minimize the cutting length and at the same time to maximize the loading of the cutting support. This predetermination of the orientation will be carried out mathematically for each single crystal from measurements taken to determine the geometric error of each single crystal relative to the crystalline network in the direction y including subsequent requirements of the process relative to the crystalline axes. The mounting of the single crystals on a cutting support could thus take place with a positioning device which permits exact measurement of the geometric angles of rotation of the single crystals, and mounting them as such on a common cutting support which is an indexable member associated with the cutting machine. The single crystals can be clamped or preferably cemented on the cutting support, which support once transferred to the cutting machine will have perfectly preoriented single crystals ready to be sawed without subsequent adjustment.

Moreover, the cutting precision will be independent of the machine used or of the operator in the case of mass production.

The positioning device will be in the form of a table or a frame with a rotating plate having its axis of rotation z''' vertical, on which is disposed the cutting support on which the single crystals will ultimately be secured. This support has an indexing system identical to that of the cutting machine. The single crystal support is an interfacial member between the positioning device and the cutting machine. It will therefore have the same position in the positioning device and in the cutting machine. Above the rotating plate but fixed relative to the table is located a mechanism permitting holding the single crystal and turning it about its horizontal axis x with moreover the possibility of displacement along this same axis x. This system is comprised, in the case of cylindrical single crystals, of a gripping system permitting the gripping of the single crystal by its end. The single crystal can then turn about its x axis parallel to its length. The movement of the plate and the rotation of the single crystal permit positioning it in any orientation. The value of the two angles of rotation will be determined by the requirements of the finished product and mathematically calculated. The displacement mechanism along x permits positioning this single crystal no matter where on the cutting support so as to ensure maximum loading. Once the two rotations and the translation in the x direction have taken place, a mechanism presents the support with the single crystal itself whilst preserving their relative position. This can take place either by raising the rotatable platform or by lowering the single crystal. Once in contact, the single crystal will be secured or cemented in position. The operation will be repeated with other single crystals until complete filling of the cutting support. The cutting support will then be transferred to the cutting machine. The single crystals are then oriented, ready to be simultaneously cut. The angles of rotation about x and z''' are measured by integrated electronic devices such as encoders or mechanical verniers for example.

FIG. 1 shows an example of single crystal 2 to be cut, which has a cylindrical shape with geometric axes x,y,z, axis x being the principal axis. The axes x',y',z' of the crystal lattice of this single crystal are not parallel to the geometric axes. The angles a and f between the axes y',y and z',z are determined by optical or x-ray measurement and generally define the error of production of the single crystal. FIG. 1 also shows the selected or imposed cutting plane 12 of the single crystal with its axes y'' and z'' inclined by angles p and t relative to the axes y',z' of the crystal lattice and the normal x'' to the cutting plane. The angular values p and t are generally defined as a function of requirements of the ultimate use of the cut single crystal. Of course these angles p and t could for example be equal to zero in the case in which it is desired to obtain silica wafers cut parallel to the plane (100).

Figure 2A:
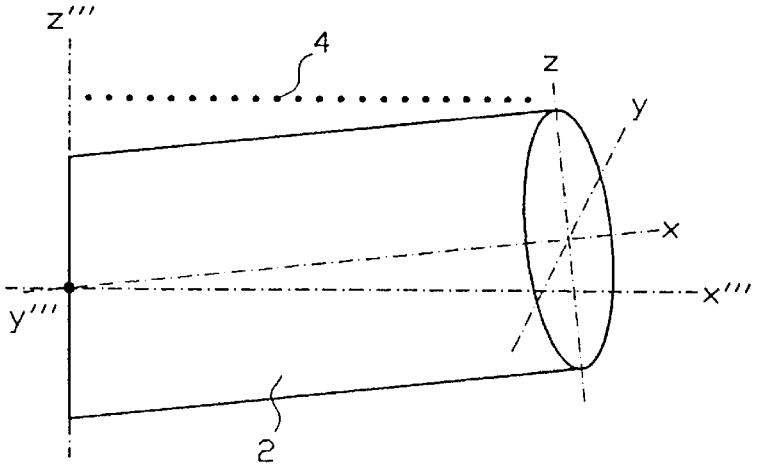
FIGS. 2A and 2B show in two orthogonal views the position of the single crystal obtained by a known process and used at present, which does not permit simultaneously cutting several single crystals.
Figure 2B:
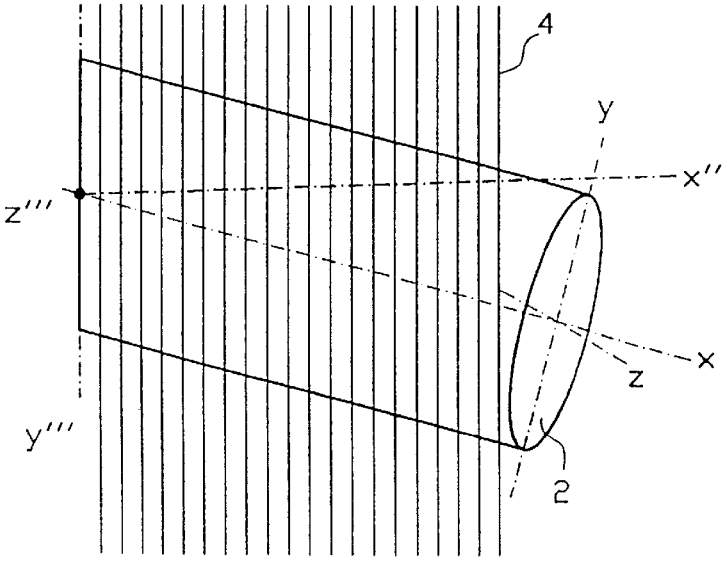

FIGS. 2A and 2B show in side and plan view the position of the single crystal 2 obtained by the known process and used at present before the present invention by carrying out an orientation of the single crystal by rotation about the geometric axes y and z. The single crystal 2 is thus not parallel to the plane of the layer of wires 4 in the case of use of a wire saw as the cutting means. The machining plan x''',y''' of the cutting machine is not parallel to the geometric axis x of the single crystal 1. The direction of advance z''' of the layer of wires 4 is not perpendicular to the single crystal, which is prejudicial to the quality of the cut, moreover it does not permit mounting several single crystals having different orientations.

Figure 3A:
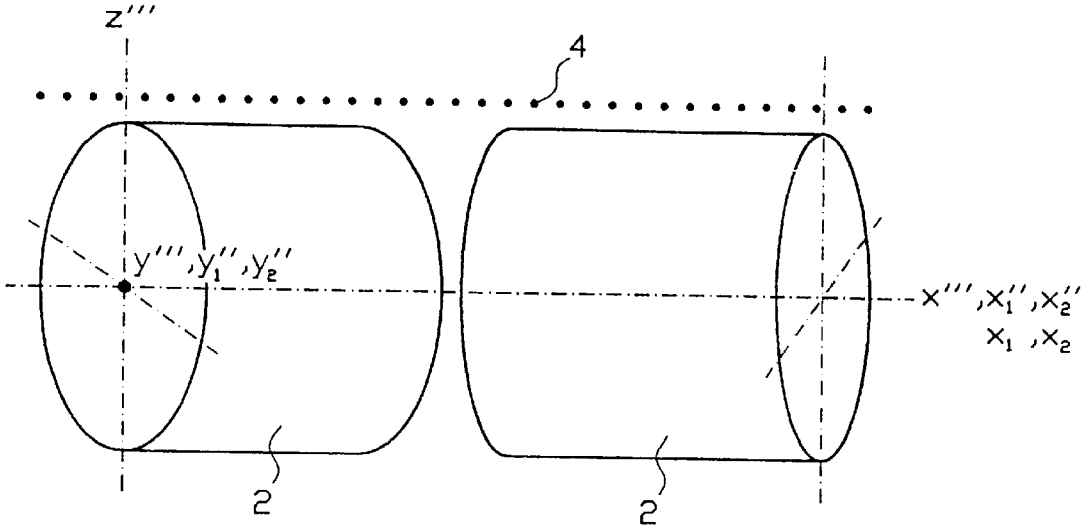
FIGS. 3A and 3B show in two orthogonal views the positions of two single crystals obtained according to the present invention.
Figure 3B:
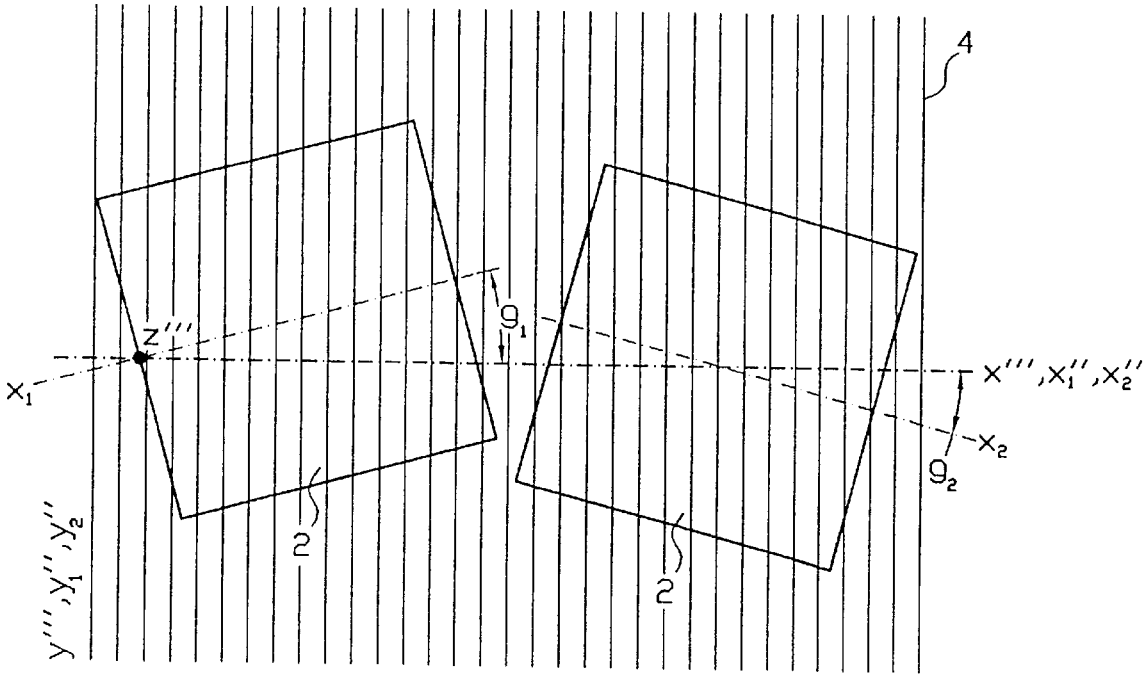

FIGS. 3A and 3B show the orientation of single crystals obtained by the process according to the present invention, by carrying out an orientation of the single crystals by rotation about axes $x_1$,$x_2$ and z'''. The layer of wires 4 of the wire saw used as cutting machine is located in the plane x''',y''' and the geometric axis $x_1$,$x_2$ of the single crystals is parallel to this plane x''',y'''. Each single crystal is thus located in an optimum position relative to the cutting means, so as to obtain a very precise cut.

Figure 4:
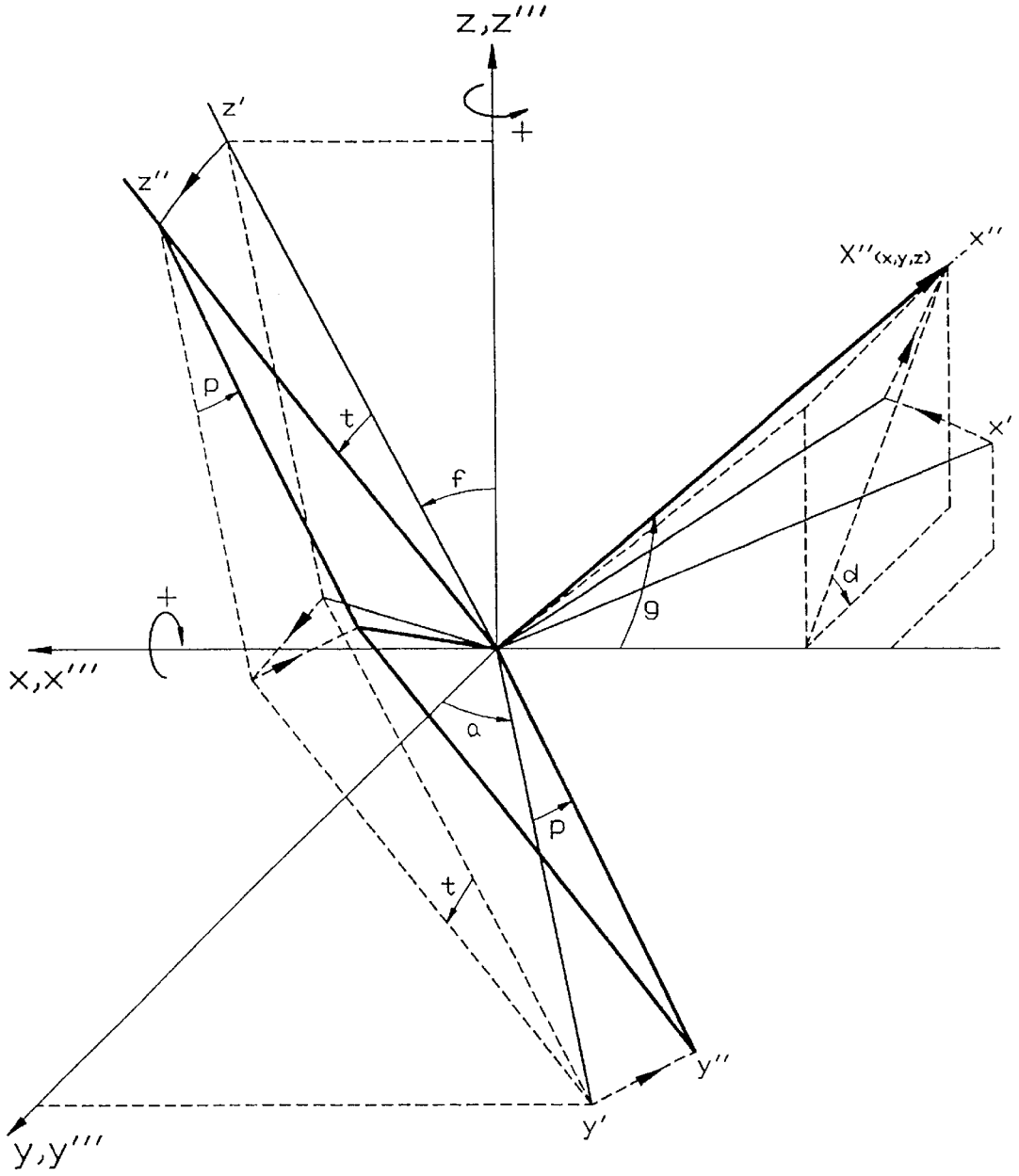
FIG. 4 shows a vectorial scheme of the different references used.

The vector scheme of the various references used for positioning is shown in FIG. 4 and comprises the reference x,y,z associated with the geometric shape of the single crystal, the reference x',y',z' associated with the crystal lattice of the single crystal, the reference x'',y'',z'' corresponding to the cutting plane of the single crystal and the reference x''',y''',z''' used for the positioning device and the cutting machine.

The cutting plane corresponds to the plane y'',z'' and its normal corresponds to the direction x''. The error of alignment of the geometric shape of the single crystal 2 with the crystal lattice is determined by the angles a and f, corresponding to the angles y'y and z'y. The angles p and t corresponding to the angles y''y' and z''z' determine the orientation of the cutting planes selected relative to the reference of the crystal lattice. The normal x'' to the cutting plane y''z'' defines a vector x''(x,y,z) which forms an angle g with the geometric axis x and the projection of the vector X''(x,y,z) in the plane y,z forms an angle d with y.

The angle d thus corresponds to the angle of rotation about the geometric axis x to bring the normal x'' to the cutting plane y'',z'' into a reference plane corresponding to the working plane x''',y''' of the machine.

The angle g corresponds to the angle of rotation about the vertical axis z''' such that the normal x'' to the cutting plane will be oriented in a reference direction corresponding to the normal x''' to the cutting plane y''',z''' of the machine to cause to coincide the desired cutting plane with the cutting plane of the cutting machine.

The angles d and g can be computed for each single crystal and the mathematical solution will be in the following form:

X'−M(a,f)X wherein M(a,f) is the matrix of rotation for the angles a,f and

X''=M(t,p)X' where M(t,p) is the matrix of rotation for the angles p,t.

It follows that the two angles d and g for each of the geometric single crystals according to x and z''' will be obtained by the components x''x, X''y, X''z and X''(x,y,z) in the reference x''',y''',z''' wherein X'' is the vector normal to the plane y'',z'' in the reference machine.

d=arctang (X''z/X''y)

g=arctang ((sqrt(X''y2+X''z2))/X''x)

Figure 5A:
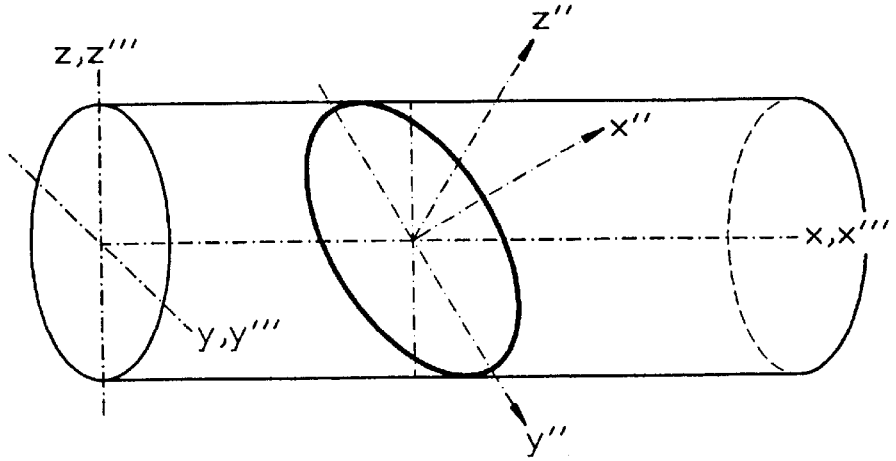
FIGS. 5A, 5B, 5C show the positions occupied by each of the single crystals according to the orientation process used by the present invention.
Figure 5B:
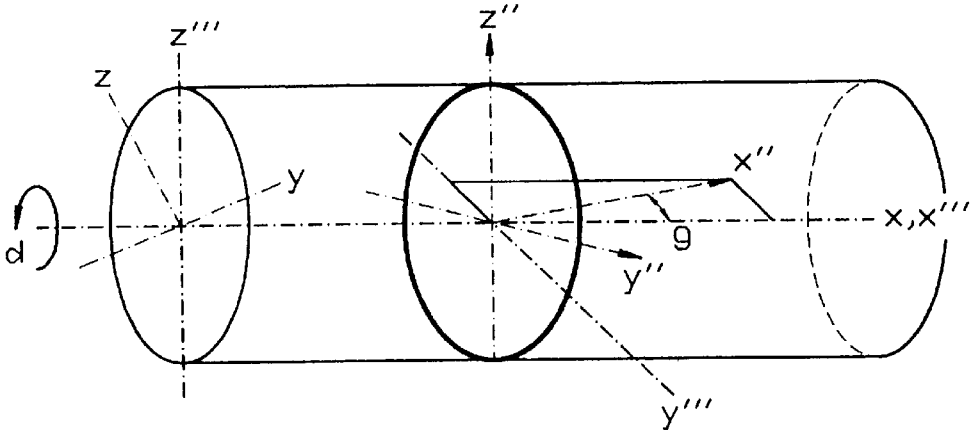
Figure 5C:
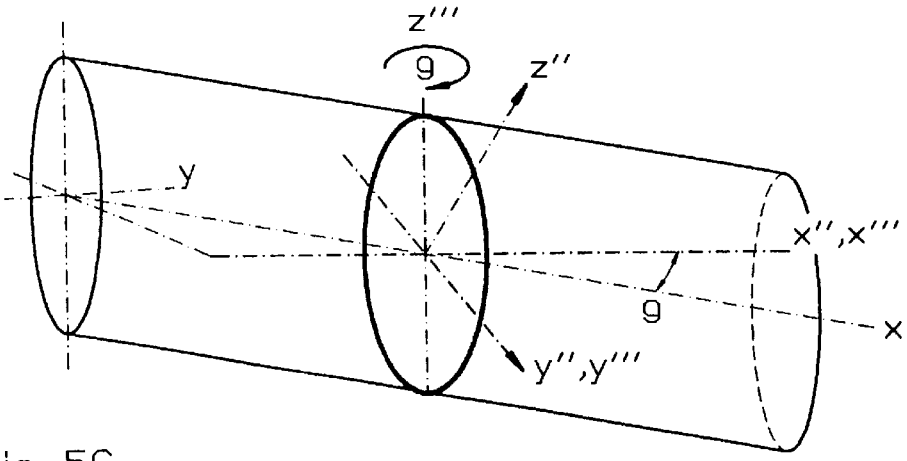

The positioning process to obtain optimum orientation shown in FIGS. 3A and 3B is described more particularly with reference to FIGS. 5A, 5B and 5C showing three successive positions. In FIG. 5A, the single crystal is disposed on the positioning device and its geometric axes x,y,z are aligned with the axes x''',y''',z''' of the alignment device and of the cutting machine.

Figure 6:
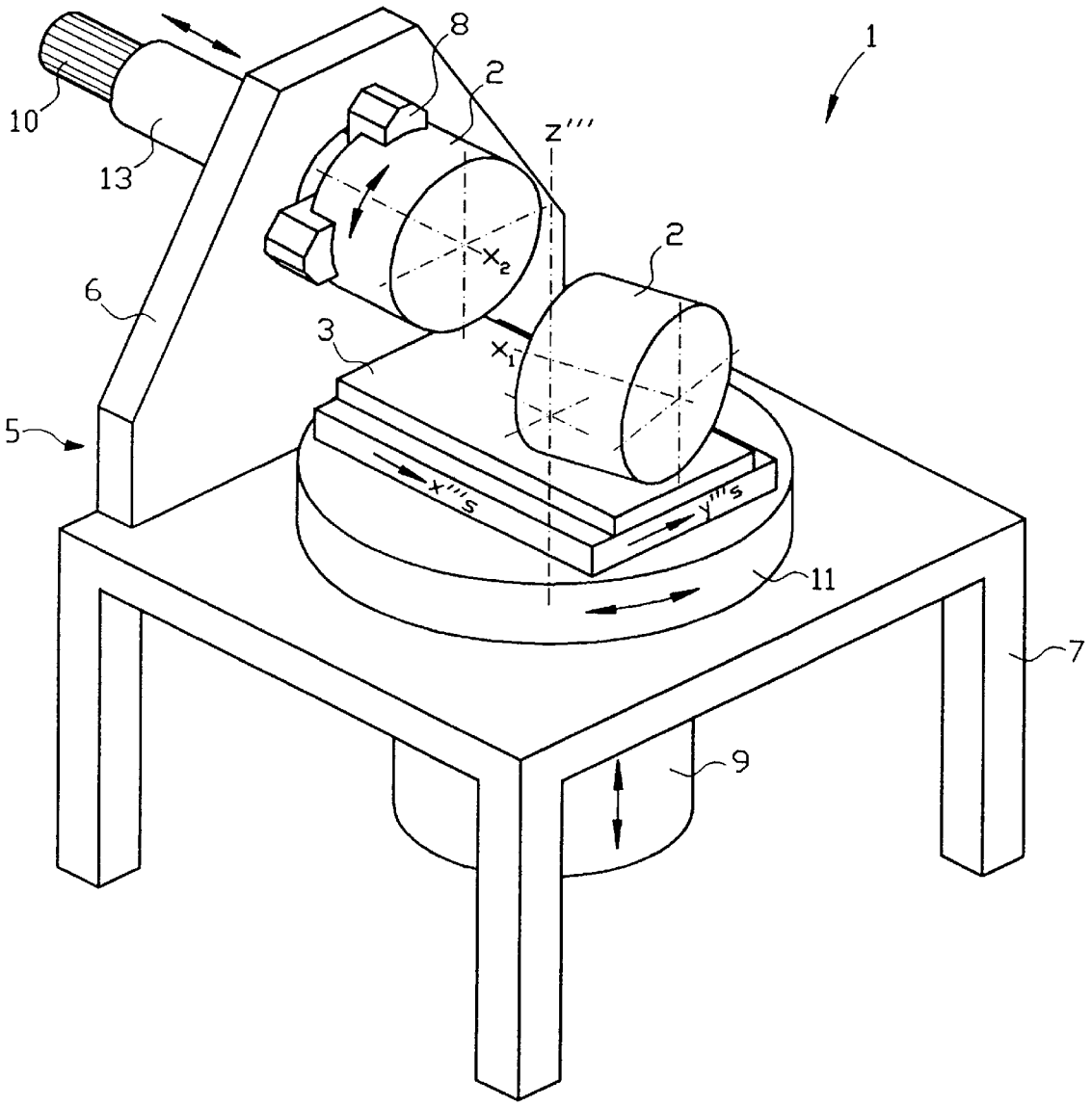
FIG. 6 is a perspective view of an embodiment of the device for practicing the process.

There is then performed a rotation about the geometric axis x''' or x of the angular value d to bring the vector X'' into the plane x''',y''' (FIG. 5B). A rotation about an angle g of the geometric single crystal about the axis z''' brings the vector X'' into a position colinear with the axis x''' (FIG. 5C). After these two rotations, the geometric single crystal x,y,z is oriented parallel to the plane x''',y''' with an angle g relative to the normal X''' to the cutting plane corresponding to the requirements of the process ultimately used. The resulting sawing will have the angles t and p relative to the crystallographic axes y' and z'. Of course the second rotation could also be effected by turning the cutting support through an angle -g, the single crystal remaining motionless as in the embodiment shown in FIG. 6.

This latter is constituted by a positioning device 1 which permits orienting each single crystal 2 outside of a cutting machine, according to an orientation predetermined relative to a cutting support present in the form of a support 3 on which the single crystal will be secured after a suitable orientation. The positioning device 1 comprises for this purpose a table or a frame 5 with an upper portion 6 and a lower portion 7.

The single crystal 2 to be oriented is carried by a gripping device 8 turning about its principal axis oriented parallel to the axis x. An angular measurement member, in the form of an encoder 10, permits measuring the angle of rotation d of the single crystal about the axis x. The gripping device 8 can move linearly in the direction x thanks to a translatory mechanism 13.

A rotatable plate 11 is mounted swingably about the axis z''' on the lower portion 7 of the frame 1. An angular measurement system integrated into the rotatable plate 11 permits measuring the angle of rotation g about the axis z ', ". The support 3 is maintained in a precisely predetermined position on the rotatable plate 11.

The rotatable plate 11 is also mounted slidably in the direction z''' on the lower portion 7 of the frame so as to be able to approach the support 3 of the single crystal 2, by means of a raising system 9 to fix the single crystal 2 on the support 3. After the successive securement of several single crystals, the support 3 and the single crystals 2 can be disposed in the cutting machine in a predetermined geometric position such that the reference plane $x'''_s$,$y'''_s$ of the support 3 corresponds to the working plane x''',y''' of the cutting machine and such that the perpendicular x''' to the cutting plane of the machine will be parallel to the reference direction $x'''_s$ of the support.

Figure 7A:
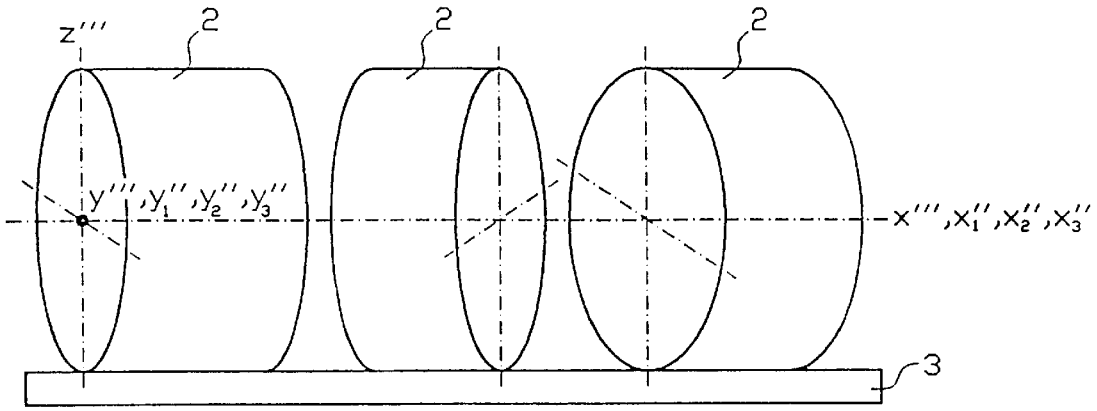
FIGS. 7A and 7B show in two views the positioning of three single crystals oriented on a cutting support.
Figure 7B:
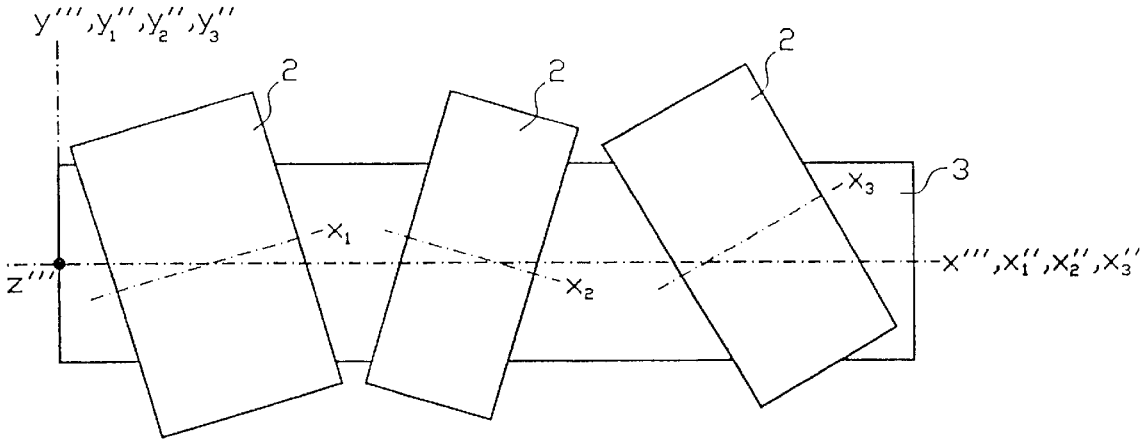

Thus the described device using the process described in detail permits the performance of the present invention, namely the positioning of several single crystals on a cutting support outside the cutting machine in such a way that the single crystals, once mounted on their support and introduced into a cutting machine, will be cut simultaneously with a given orientation of the crystal axes relative to the sawing plane. Moreover, the position of the cylindrical single crystals is such that the generatrices of these latter will be disposed parallel to the layer of wires 4 in the case of a wire saw or parallel to the direction of movement defining the thickness of the slices in the case of slicing. For this, the orientation of the crystal lattice is measured relative to the geometric shape of the single crystal, optically, or by means of x-rays. The positioning device 1 or the cutting support 3 could for this purpose preferably be arranged to be adapted to be mounted on an x-ray generator such that the positioning of the single crystals can be effected and controlled simultaneously. The orientation of the cutting plane y",z" relative to the crystal lattice x',y'z' being imposed by the ultimate use, the values of the two angles of rotation of the single crystal d about the axis x and g about the axis z''' of the positioning device are determined mathematically. Once the two rotations are carried out according to the values calculated for each single crystal, the single crystals will be located in the desired position for the cutting machine, namely perpendicular to the direction of advance (z''') of the cut having moreover their cutting planes ($y_1$"$z_1$"$y_2$"$z_2$", $y_3$"$z_3$") parallel to that (y'''z''') of the machine, as is shown in FIGS. 7A and 7B for three single crystals Z having crystallographic axes x1,x2,x3 parallel to the plane x'''y''' of the cutting machine and of the support 3. The positioning device will permit the securement of the single crystals with by clamping or by cementing on the support 3 preindexed relative to the cutting machine. Moreover, the orientation given by the process minimizes, in the case of cylindrical single crystals, the sawing length. The cutting machine requires no adjustment device to ensure cutting according to required angular specifications after transfer of the single crystals onto the cutting support and onto the support of the latter in the cutting machine. The layer of wires of a wire saw remains parallel to the geometry of the single crystals during all the cutting whilst ensuring a suitable orientation of the wafers thus produced. Similarly, the saw blade of a bladed machine remains perpendicular to the single crystals.

Of course the embodiment described above is in no way limiting and can be the subject of all desired modifications within the scope defined by claim 1. In particular, the two angles of rotation about the axes x and z''' could be replaced by angles taken and calculated relative to other geometric and crystallographic references, but which lead to the same result, namely, that the normal to the cutting plane of each single crystal is oriented in a reference direction corresponding to the normal to the cutting plane of the machine and that a predetermined geometric axis of each single crystal and the normal to the cutting plane lie in a reference plane corresponding to the working plane of the machine. Similarly, the cutting plane could be determined by other angles than p and t relative to the crystal lattice and the offset of the crystal lattice relative to the geometric shape of each single crystal could be indicated by other measured angles than a and f.

The gripping devices could be replaced by other means to support the single crystal in the course of orientation and to carry out a rotation of said single crystal, such as for example cylinders on which said single crystal is temporarily positioned and which are rotatably mounted on the table or the frame. Rotation supports could be arranged for the two opposite ends of the single crystal. The relative rotation between said single crystal and the cutting support about the axis z''' could also be effected by a rotation of said single crystal relative to the cutting support which would remain motionless on the table or the frame of the positioning device. The rotatable plate would then be replaced by a member rotatable about z''' and carrying the temporary support of the single crystal.

The angular measurement members could be electronic, optical or mechanical.

The approach or the placing in contact of the single crystal and the cutting support could be carried out from below or from above and by moving either the cutting support or said single crystal.

The rotations about the two horizontal and vertical axes x,z''' could be reversed in sequence by carrying out first the rotation about the axis z''' and then the rotation about the horizontal axis x.

The translation parallel to the x could be carried out by displacing not the single crystal but the cutting support.

The process and device could also be used for oriented cutting of single crystals of any other geometric shape or of any other material than a single crystal, such as polycrystalline groups with predetermined crystalline orientation, simple twined or polysynthetic crystals, oriented crystalline aggregates, alloys, oriented crystalline substances contained in an amorphous substance, for example polarizing materials, or simply to give a particular shape to the obtained wafers.

I claim:

1. A method of simultaneously cutting a plurality of single crystals in a cutting machine along a predetermined cutting plane (y",z") comprising the steps of:

individually orienting each of a plurality of said single crystals to a predetermined orientation relative to a cutting support using a positioning device, said positioning device being located separate from said cutting machine;

individually securing said single crystals on said cutting support in accordance with said predetermined orientation;

positioning said cutting support in said cutting machine to obtain said predetermined orientation of said single crystals, wherein said positioning of said cutting support in said cutting machine is geometrically defined relative to a cutting plane (y'",z'") of said cutting machine; and operating said cutting machine to simultaneously cut said plurality of single crystals.

2. The method of claim 1, wherein said step of orienting said single crystals to a predetermined orientation relative to a cutting support using a positioning device, further comprises the step of positioning said single crystals on said positioning device so that a geometric axis (x) of a geometric shape (x,y,z) of each single crystal will lie in a reference plane (x'"s,y'"s) of said cutting support corresponding to a working plane (x'",y'") of the cutting machine perpendicular to the cutting plane (y'",z'"), by effecting a rotation of said each single crystal by a first predetermined angle (d) of said each single crystal about said geometric axis (x) to bring a first normal (x"), said first normal being normal to the predetermined cutting plane (y",z") of the said each single crystal, into said reference plane, and by effecting relative rotation between the cutting support and said each single crystal through a second predetermined angle (g) for said each single crystal about an axis (z'") perpendicular to said reference plane such that the first normal (x") will be oriented in a reference direction corresponding to a second normal, said second normal being normal to the cutting plane (y'",z'") of the machine, said geometric axis (x) and the first normal (x") of said each single crystal lying in said reference plane.

3. The method of claim 2, further comprising the step of mathematically determining the first and second predetermined angles (d,g).

4. The method of claim 3, wherein said step of orienting said single crystals to a predetermined orientation relative to a cutting support using a positioning device, further comprises, for said each single crystal, individually orienting the predetermined cutting plane (y",z") of said each single crystal relative to a crystal lattice (x',y',z') of said each single crystal so that an orientation of the crystal lattice (x',y',z') is measured relative to the geometric shape (x,y,z) of said each single crystal, and so that the first and second predetermined angles (d,g) are calculated based on an orientation of the predetermined cutting plane (y",z") relative to the crystal lattice (x',y',z') and relative to the geometric shape (x,y,z) of said each single crystal.

5. The method of claim 4, wherein said orientation of the crystal lattice (x',y',z') relative to the geometric shape (x,y,z) is determined by one of optical and x-ray means.

6. The method of claim 2, wherein said single crystals are substantially cylindrical, and wherein said geometric axis (x) of said each single crystal corresponds to a principal crystal axis of said each single crystal.

7. The method of claim 6, wherein the steps of orienting said single crystals to a predetermined orientation, and securing said single crystals on said cutting support, is accomplished using a gripping system of the positioning device, wherein the axis of rotation of the gripping system is maintained parallel to said reference plane.

8. A device for orienting a plurality of single crystals (2) for their cutting in a cutting machine along a predetermined cutting plane (y",z"), comprising:

a cutting support on which a plurality of said single crystals (2) are adapted to be secured and for emplacement in said cutting machine, which emplacement in said cutting machine is geometrically defined and whose principal axes ($x'''_s$, $y'''_s$) are parallel to axes (x'", y'") of a working plane of the cutting machine;

a positioning device (1) adapted to orient said single crystals (2), outside the cutting machine, according to a predetermined orientation relative to said cutting support (3); and a positioning means (13 & 9) adapted for individually placing said single crystals (2) on said cutting support (3) secured conjointly and in a compact manner with others of said single crystals.

9. Device according to claim 8, further comprising a first means (8) to support each single crystal (2) in an orientation such that a geometric axis (x) of a geometric shape (x,y,z) of said each single crystal lies in a reference plane ($x'''_s$,$y'''_s$) corresponding to the working plane (x'",y'") of the cutting machine and to effect a rotation of said each single crystal (2) through a first predetermined angle (d) about said geometric axis (x) to bring a first normal (x") to a predetermined cutting plane (y",z") of said each single crystal into said reference plane, and a second means (11) to carry out a relative rotation between the cutting support (3) and said each single crystal (2) through a second predetermined angle (g) about an axis (z'") perpendicular to said reference plane such that the first normal (x") will be oriented in a reference direction corresponding to a second normal (x'") to a cutting plane (y'",z'") of the cutting machine.

10. Device according to claim 8, wherein said positioning means comprises, a third means (13) permitting a relative displacement about the geometric axis (x) of said each single crystal (2) to permit compact assembly of said single crystals (2) on the cutting support, and a fourth means (9) to carry out a relative translatory movement between said each single crystal (2) and the cutting support (3) adapted to bring together the cutting support (3) and the single crystal (2) so as to secure said each single crystal on the cutting support, in said predetermined orientation.

11. The device of claim 10, wherein the first means comprises a gripping system (8) mounted rotatably about an axis of rotation on an upper portion (6) of a frame (5) of the positioning device (1), said gripping system being arranged to support said each single crystal (2), and a first angular measurement means (10) adapted to determine the first predetermined angle (d), said second means comprises a rotatable plate (11) mounted pivotably relative to said frame (5), said rotatable plate having a principal plane parallel to said reference plane and to the axis of rotation of said gripping system (8), the rotatable plate (11) being arranged so as to maintain the cutting support (3) in a predetermined geometric position, said rotatable plate (11) comprising a second angular measurement means for determining said second predetermined angle (g);

said third means comprises a first translatory mechanism (13) parallel to said axis (x) of rotation to permit positioning said each single crystal (2) over the cutting support (3); and said fourth means comprises a second translatory mechanism (9) in a direction (z'") perpendicular to said reference plane to permit moving together of said each single crystal (2) and said cutting support (3).

12. The device of claim 11, wherein said cutting support (3) is shaped for emplacement in said cutting machine in a geometrical position corresponding to the geometrical position defined on said rotatable plate (11) such that the reference plane (x'"s,y'"s) and the reference direction correspond to the working plane (x'",y'") and to the second normal (x'") to the cutting plane of the cutting machine.

13. The device of claim 8, wherein one of said cutting support and said positioning device is adapted to be mounted on an x-ray generator.

* * * * *